United States Patent [19]

Lombardo

[11] 3,942,793

[45] Mar. 9, 1976

[54] BASEBALL

[75] Inventor: Gus F. Lombardo, St. Louis, Mo.

[73] Assignee: International Sporting Goods, Inc., St. Louis, Mo.

[22] Filed: July 25, 1973

[21] Appl. No.: 382,292

[52] U.S. Cl...... 273/26 R; 273/60 R; 273/DIG. 20; 272/59 B

[51] Int. Cl.[2]..... A63B 69/40; A63B 37/04

[58] Field of Search ..... 273/60, 26, DIG. 20, 25; 272/59 B

[56] References Cited

UNITED STATES PATENTS

| | | | |
|---|---|---|---|
| 172,315 | 1/1876 | Hipkiss | 273/60 R |
| 1,206,463 | 11/1916 | Parkinson | 273/DIG. 20 |
| 1,270,008 | 6/1918 | Cobb | 273/62 |
| 1,597,308 | 8/1926 | Brandt | 273/DIG. 20 |
| 1,873,221 | 8/1932 | Senn | 273/60 R |
| 1,911,569 | 5/1933 | Hinckley | 273/60 R |

OTHER PUBLICATIONS

"Times Herald", Washington, D.C., Sunday, May 14, 1939.

*Primary Examiner*—George J. Marlo
*Attorney, Agent, or Firm*—Paul M. Denk

[57] ABSTRACT

In a weighted ball formed having a central core either constructed entirely of metal, or having embedded therein, or surrounded by, a weighted member constructed perferably of metal, said ball having an intermediate filler material usually constructed of wound yarn, with a horsehide or other hide type of cover securely stitched in place to provide the finished product, said ball having a composite weight slightly in excess of a standard and regulation ball of the usual construction.

3 Claims, 6 Drawing Figures

FIG. 1
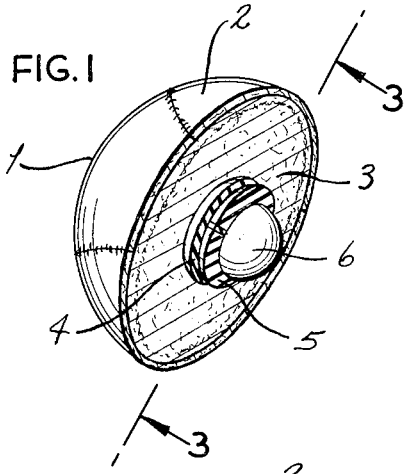
FIG. 3
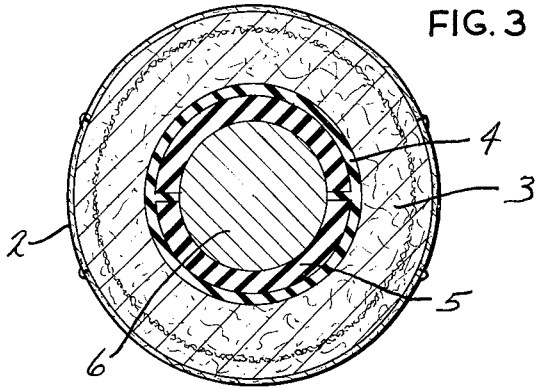
FIG. 4
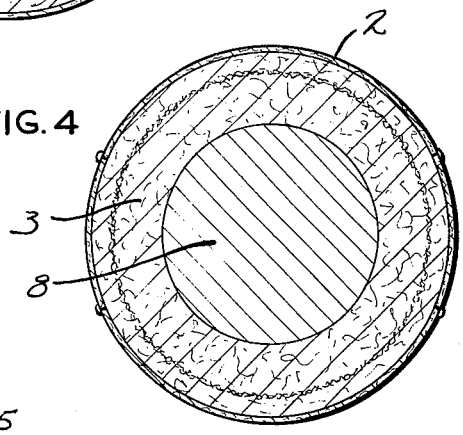
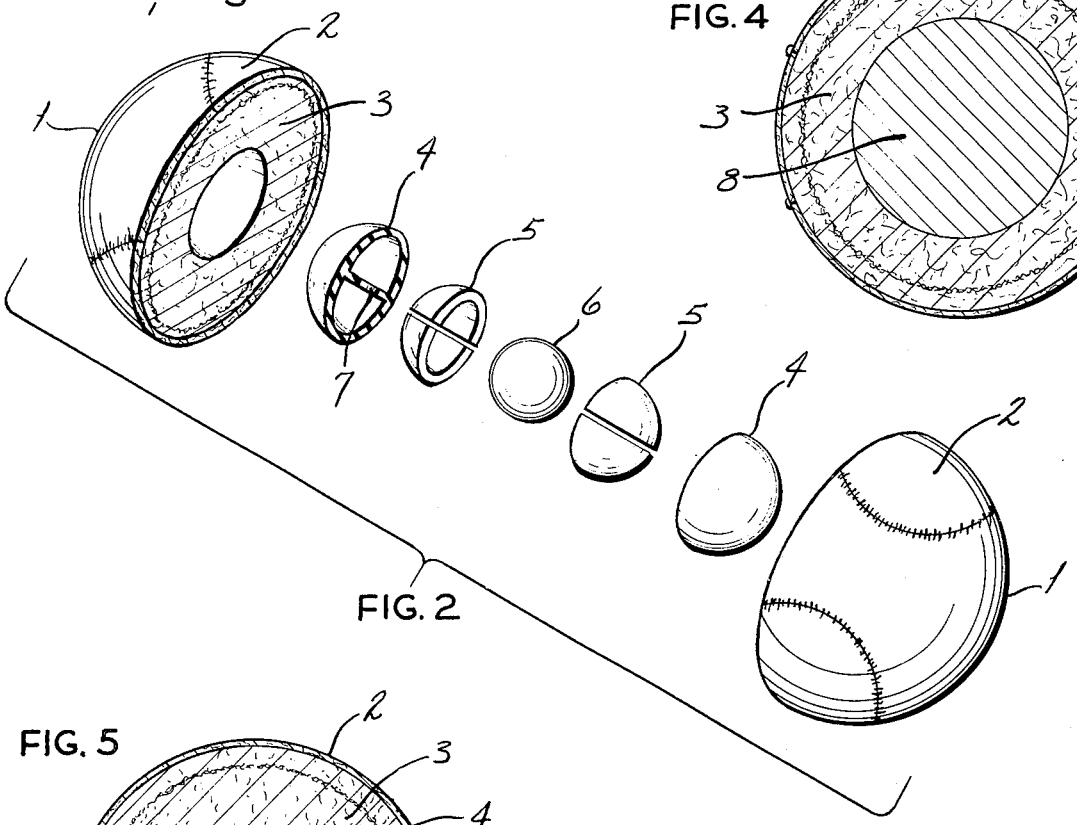
FIG. 2
FIG. 5
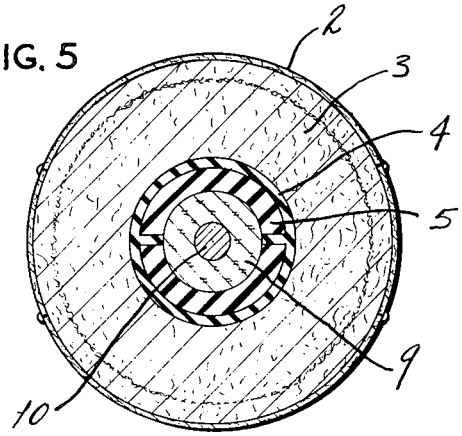
FIG. 6
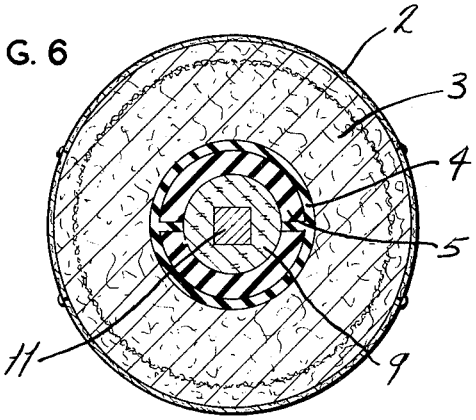

BASEBALL

BACKGROUND OF THE INVENTION

This invention relates generally to an adaptation to a ball used in various sporting events, such as a baseball, softball, or the like, and more particularly, pertains to such a ball into which has been incorporated a weighted member that slightly increases to a precise degree the weight of the ball for the purpose of assisting in strengthening the arm and accompanying muscles of a pitcher or other player without causing a loss of his control.

Various golf balls, handballs, and bowling balls have been provided in the prior art incorporating a weight therein either for the purpose of providing greater impact to achieve a further carry to the ball in flight, such as in the case of a golf ball, or such weights have been provided as a means for adjusting the standard weight of the ball so as to accommodate a wider range of users, although the weight of the ball as adjusted is still within the range of weight established by league regulations for such a ball, as in the case of the bowling ball. An example of the foregoing type of golf ball is disclosed in the patent to Young, U.S. Pat. No. 1,946,378, wherein a spherical center weight of metal is provided within the golf ball mainly to enhance the distance that it may be driven during usage. A summary of the latter type of a ball comprising the bowling ball and incorporating adjustable weights is disclosed in the patent to Rolke, U.S. Pat. No. 3,181,864, and therein discloses a complex series of weights which may be adjusted within the separable portions of a bowling ball so as to vary its weight to better adapt it to the bowler.

The present invention is more concerned with the incorporation of slight amount of additional weight within the standard ball, such as a baseball, so that the pitcher or other players during practice may utilize this ball for the purpose of strengthening the muscles within there back and arms, and without disrupting the degree of control they have acquired over their throw of the ball, particularly in the case of a pitcher. Various other types of weighted members have been provided for use during practice by athletes for the purpose of making them more limber when exposed to game conditions, and one such example is disclosed in the patent to Owen, U.S. Pat. No. 3,116,926, wherein a weighted baseball bat is provided for the purpose of enhancing the batting ability of the player during the game. This type of a bat is normally utilized by the player just prior to his taking a turn at bat during the game, and is primarily designed to provide an excessively heavy bat which can be swung a few times during warm up, and then replaced while at the plate by the batter's standard bat that makes the latter seem much more lighter and easier to swing. The object achieved by this type of a prior art devise is mainly concerned with the use of an equivalent device of a much greater weight which burdens the exerted muscles to an overworked condition, making them more responsive during use, particularly when a much lighter type of the same instrument is then immediately employed. This has been done with baseball bats, and in particular instances, the applicant has even heard of a baseball itself constructed entirely of lead or other metal and being utilized for the same purpose. These types of prior art devises while useful in perhaps strengthening, if not over strengthening, the muscles, have a tendency to cause extreme loss of control, and hence, particularly in the case of the lead baseball, are unthinkable for use by a pitcher during warm up.

It is the principal object of the present invention to provide a baseball, or the like, which includes a weighted member which only slightly exceeds the weight of the standard baseball so that the player during spring training and warm up can gradually tone his muscles, particularly in the vicinity of the upper arm, back and shoulders, without losing the delicate touch for control which is so essential to a player, particularly a pitcher.

Another object of this invention is to provide a set of baseballs or the like, which incorporate a weighted core which increases the weight of the balls within the range of from only a fraction of a ounce to a few ounces in excess of the standard baseball so as to provide only a slight increase in the weight of the balls for the purpose of enhancing the players strength without inducing a loss of control.

These and other objects will become more apparent to those skilled in the art upon reviewing the following summary, and upon undertaking a study of the description of the preferred embodiment in view of its drawings.

SUMMARY OF THE INVENTION

This invention contemplates the adaptation of a standard baseball, softball, corkball, or any other type of ball used in sporting events and of the type requiring skill and dexterity of the player while throwing such a ball. For example, in all three of the foregoing sports extreme precision is required particularly by the pitcher in delivering the ball over the plate to the batter, usually including a variety of pitches, with such precision generally referred to as control. Frequently, and particularly during spring training, the various muscles in the arm, such as the triceps, in the shoulder, such as the pectoralis major and deltoid, and in upper back, such as teres major and trapezius, have become over rested. And, even though the pitcher may still have his desirable control, which incidentially is probably more of an inherited trait but one that can be lost, these various muscles that regulate his control need to be strengthened and toned up so that the pitcher's strength may be maintained for the length of the game without sacrificing or impairing any of this desirable control. Hence, this invention adapts the standard baseball to provide for its slight increase in weight to graduated amounts, preferably somewhere in the vicinity of from ½ ounce to 16 ounces, with said additional quantities of weight being added to the normal weight of the regulation size baseball which is constructed to weigh over 5 ounces but not to exceed 5¼ ounces. This added weight is applied to the ball in a manner which does not detract from the usual characteristics of the baseball, said increased weight preferably being embedded within the central core of the ball, which for all practical purposes, will retain its usual liveliness, with said slight additional amount of weight being somewhat undetectable but useful for achieving its intended purpose. Preferably, the weighted members added to the central core of the ball will be constructed of metal, usually of spherical shape, and will be embedded within the combination rubber and cork center usually included as the center of the standard baseball. Where the weight to be added to the ball approaches the upper limits described herein, somewhere in the vicinity of sixteen ounces, the weight itself may replace in its entirety the usual central core of the baseball, with the usual intermediate filler material comprising the yarn being wound around said weight to that amount sufficient to provide a finished ball yet having a standard diameter.

BRIEF DESCRIPTION OF THE DRAWING

In the drawing,

FIG. 1 provides a view of approximately one half of a standard baseball, showing in full a weighted member being embedded within its central core;

FIG. 2 provides an exploded view of a standard baseball incorporating a spherical weight of the type embedded within its central core as in this invention;

FIG. 3 provides a sectional view taken directly through the ball and the weighted member as along the line 3—3 of FIG. 1;

FIG. 4 provides a sectional view of a modified ball of this invention wherein the weighted member comprises a replacement for its entire central core;

FIG. 5 provides a sectional view of the modified invention wherein the weighted member is disclosed as being embedded within the central core of the ball; and FIG. 6 provides a sectional view of the modified invention wherein a nonspherical weighted member is shown embedded within the central core of the ball.

DESCRIPTION OF THE PREFERRED EMBODIMENT

In referring to FIGS. 1 and 2 of the drawings, there is disclosed a ball constructed according to the teachings of this invention wherein, in these particular sketches, comprises the standard baseball 1 having the horsehide cover 2 that is double stitched and cemented to an intermediate filler material such as a series of layers of yarn, usually four in number, that mutually pack each other, and with the outer layer comprising a cotton finishing yarn which provides the smooth firm surface upon which the horsehide cover 2 may be applied. Within the center of the wound yarn 3 are a series of rubber covers 4 and 5 which adds liveliness to the ball, giving it inherent resiliency. The rubber cover 4, while shown as separated in FIG. 2, actually comprises a solid spherical cover surrounding the hemispherical rubber shells 5 that surround the weighted member 6 of this invention, which as described comprises a spherical metal ball. It may also be commented that in the regulation baseball as commonly used in the professional game, the shells 5, while being hemispherically shaped, are slightly separated from each other and entirely covered during manufacture by the rubber cover 4, with said rubber cover 4 having a thin rib 7 that migrates into the separation between the shells 5. In the present invention, though, this feature is not critical, but rather, it is just desirable that the metal weighted members, be covered by the rubber covers 4 and 5, or either of them, so as to approximate the construction of the regulation ball.

As shown in FIG. 3, the various components that make up the standard ball, and as it has been modified according to the teachings of this invention, are shown in cross section wherein the horsehide cover 2 surround the layers of yarn 3, which in turn cover the first complete rubber cover 4, and the rubber shells 5, with the weighted member 6 being located therein. When the official baseball is constructed in this manner, its weight will be somewhere between 5.5 to 19 ounces, depending upon the type of metal, and its weight, used in the formation of the core 6.

Where it is desired to construct a ball having a weight of greater than a pound, the entire center core and the usual rubber cover and shells may be replaced by a metal weight 8, as shown in FIG. 4. In this particular construction, a central core of the ball itself will weigh approximately 1 pound, and when weighed in conjunction with its wound yarn 3 and its horsehide cover 2, will have a total weight of approximately 20 ounces. Obviously, a ball constructed in this manner loses many of the attributes of the standard baseball, particularly its resiliency and liveliness, but a ball of this nature, has previously summarized, has not been designed for actual usage in game play, but rather, is designed for application during training so as to enhance muscle toning without disrupting the player's normal control, such as a heavy weighted ball would do.

As shown in FIGS. 5 and 6, the standard baseball as previously described incorporates the cover 2, the intermediate wound yarn filler material 3, the rubber cover 4, and the rubber shells 5. In these particular modified balls, there is also shown the standard cork center that is generally used in regulation baseballs, and such a center would appear to be constructed as a treated cork made from a combination of a rubber and cork composition, that adds the desired resiliency and liveliness to the standard game ball. Also shown being embedded within this cork center 9, as in FIG. 5, is a weighted member 10, which may be constructed as a spherical metal ball, adding approximately a quarter to a half ounce to the weight of the ball. As shown in FIG. 6, this weighted member may have a nonspherical shape, such as the cube of metal 11, as shown. These weights are designed to add only a slight amount of weight to the standard ball, and may be used as the finishing ball at a time when the player's muscles have been almost completely toned, and when he feels that he has strengthened his muscles to the point where he can achieve peak performance with the standard baseball.

As previously analyzed, the object of this invention is to provide a slight additional amount of weight to the standard type of ball, rather it be the baseball, a softball, a corkball, or any other type of ball which usually requires skill particularly of its pitcher, with said slight additional amount of weight providing the agency with which the pitcher may strengthen his muscles without sacrificing any of his important control. Since the object is just to add a slight amount of weight to such a ball, it is also likely that weight may be applied under slightly modified conditions but yet achieve the same results as herein analyzed and desired. For example, the standard ball, as shown in FIG. 5, incorporating the cork center 9, instead of applying a weighted member 10, may have a solid cork center 9 and have a coating of a thin metal shell around the same, or perhaps even around one or more of the rubber covers 4 and 5. In this manner, the weighted member may be added symetrically to the ball, and add for useful purposes the slight additional amount of weight at precise quantities to the ball and be used for muscle toning by the athelete.

Many other variations may be thought of by those skilled in the art upon reviewing the subject matter of this disclosure, and such variations are intended to be covered by the claims herein set forth which are designed to protect the spirit and scope of this invention.

Having thus described the invention, what is claimed and desired to be secured by Letters Patent is:

1. In a baseball incorporating as components thereof a central core surrounded by wound yarn and having an outer cover, said components jointly having an overall weight of over 5 ounces but not in excess of 5¼ ounces, the improvement which comprises a weighted member embedded within the center of said core and thereby increasing said overall weight an additional 0.5 ounce to 16 ounces, said weighted member being formed of metal and being smaller than said central core in which it is embedded so that the increase in said overall weight enables said baseball to be used for toning muscles and perfecting the pitching arm of a baseball player, without sacrificing pitching control.

2. The invention of claim 1 wherein said weighted member is spherical in shape.

3. The invention of claim 1 wherein said weighted member is of a nonspherical shape.

* * * * *